US005800146A

United States Patent [19]

Jünemann et al.

[11] Patent Number: 5,800,146

[45] Date of Patent: Sep. 1, 1998

[54] LIQUID-RING GAS PUMP WITH A SILENCING ELEMENT IN THE DISCHARGE SPACE

[75] Inventors: Alfons Jünemann, Itzehoe; Günther Struck, Oelixdorf, both of Germany

[73] Assignee: SIHI GmbH & Co. KG, Itzehoe, Germany

[21] Appl. No.: 849,870

[22] PCT Filed: Dec. 22, 1995

[86] PCT No.: PCT/EP95/05093

§ 371 Date: Jun. 17, 1997

§ 102(e) Date: Jun. 17, 1997

[87] PCT Pub. No.: WO96/20346

PCT Pub. Date: Apr. 4, 1996

[30] Foreign Application Priority Data

Dec. 23, 1994 [DE] Germany ..... 9420803 U

[51] Int. Cl.[6] ..... F04C 19/00

[52] U.S. Cl. ..... 417/68; 417/312; 181/229

[58] Field of Search ..... 417/68, 69, 312; 181/229, 255

[56] References Cited

U.S. PATENT DOCUMENTS

| | | | |
|---|---|---|---|
| 4,779,703 | 10/1988 | Takigucji et al. | 181/255 |
| 4,929,157 | 5/1990 | Steele et al. | 417/312 |
| 5,133,647 | 7/1992 | Herron et al. | 417/312 |

FOREIGN PATENT DOCUMENTS

| | | |
|---|---|---|
| 547436 | 6/1993 | European Pat. Off. . |
| 2036295 | 9/1973 | Germany . |
| 62-017391 | 1/1987 | Japan . |
| 01 203689 | 8/1989 | Japan . |

*Primary Examiner*—Charles G. Freay
*Attorney, Agent, or Firm*—Alix, Yale & Ristas, LLP

[57] ABSTRACT

A liquid ring gas pump has a pressure space and a pressure pipe connected to the top of the pressure space. A tubular silencer is suspended from the pressure pipe and extends into the pressure space. The silencers are detachable and may be inserted through the pressure pipe. The detachable silencers are retained by an elastic ring retained in a ring-shaped groove of the pressure pipe.

6 Claims, 1 Drawing Sheet

LIQUID-RING GAS PUMP WITH A SILENCING ELEMENT IN THE DISCHARGE SPACE

CROSS-REFERENCE TO RELATED APPLICATIONS

This is the national stage of International Application No. PCT/EP95/05093 filed Dec. 22, 1995.

During the operation of liquid-ring gas pumps, severe noise arises due to the fact that the vanes of the impeller periodically brush past the opening through which the liquid/gas mixture being pumped crosses from the working space in which the impeller revolves into the discharge space. This noise can be troublesome especially when the discharge stub connected to the top of the discharge space is connected to the atmosphere. Various means have therefore been proposed (DE-C 2036295, EP-A 367845) which ensure that the sound waves within the discharge space do not pass to the discharge stub unhindered. These means include, for example, silencing elements which, in the form of tubes, extend the discharge stub downwards into the discharge space (DE-C 2036295, FIGS. 14 and 18; EP Patent No. 644332, FIG. III). However, such means have the disadvantage that they represent an obstacle not only to the sound waves but also to flow and therefore give rise to losses in efficiency. In pumps the use of which does not require special silencing measures, there is therefore a reluctance to use them. However, it is expensive to provide special series of pumps for those applications in which silencing is required.

According to the invention, this disadvantage is avoided by means of the features stated herein. According to these, the tubular silencing element is provided in such a way as to be removable, making it possible to decide case by case whether it is used or not.

According to a special feature of the invention, it can be inserted into the assembled pump from outside through the discharge stub, allowing standard pumps to be retrofitted with the silencing element without this having to be taken into account during the assembly or storage of these pumps.

The silencing element is preferably a tube which is guided in the discharge stub, and a special device can expediently be provided in the discharge stub to hold the silencing element. According to a special feature of the invention, this is an elastic sealing ring which can be inserted into a circumferential groove in the discharge stub and the frictional force of which holds the tube inserted into the discharge stub as a silencing element. A shoulder or the like can be provided on this tube and, in cooperation with the holding means or sealing ring, prevents the tube from descending further than intended into the discharge space. According to another feature of the invention, a supporting stop is provided in the discharge space, and the bottom end of the tube inserted as a silencing element is supported on this.

The invention is explained in greater detail below with reference to the drawing, which illustrates an advantageous exemplary embodiment. In the drawing.

Figure 2:
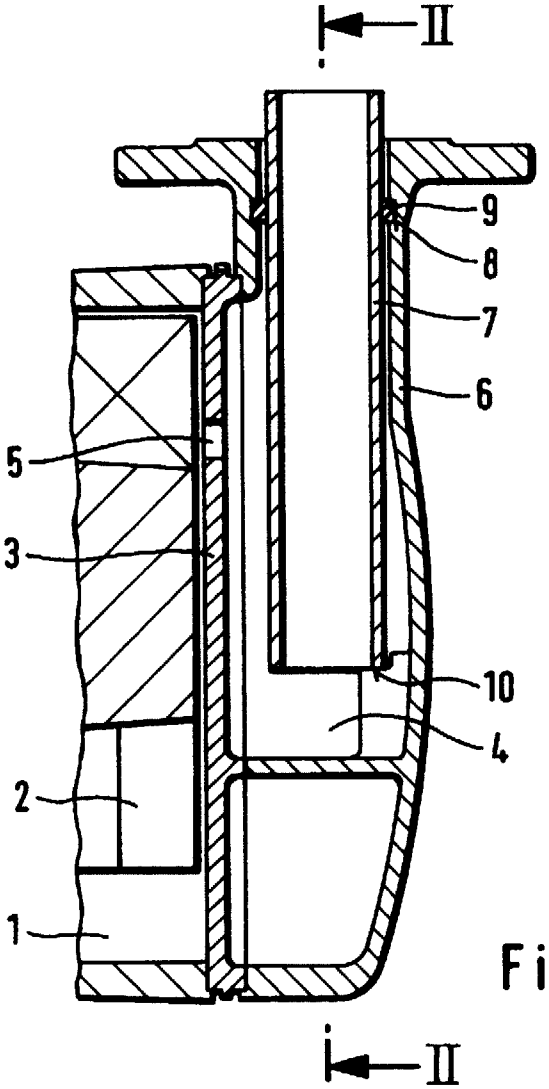
FIG. 2 shows a longitudinal section along the line I—I in FIG. 1.
Figure 1:
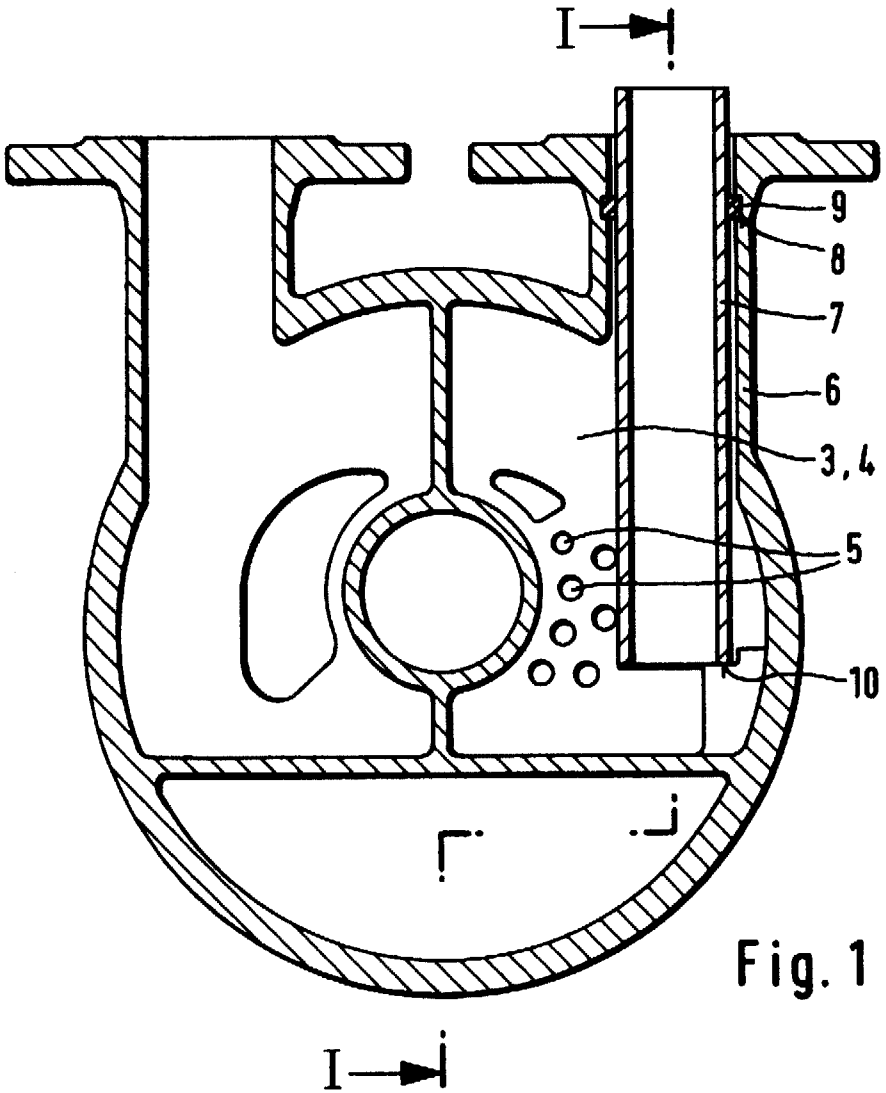
FIG. 1 shows a cross-section along the line II—II in FIG. 2.

FIG. 2 shows the working space 1 of the pump, in which the impeller 2 revolves and which is separated from the discharge space 4 by the control plate 3. The control plate 3 contains one or more discharge openings 5, through which the compressed medium crosses from the working space 1 into the discharge space 4 together with some of the operating liquid. Adjoining the discharge space 4 towards the top is the discharge stub 6, through which the gas and the excess operating liquid is discharged. In the example illustrated, the discharge stub is arranged vertically. This is advantageous but not absolutely essential.

As described thus far, the pump is known and is used for the usual application, in which special silencing means in the discharge space are not required.

According to the invention, the discharge stub 6 can have inserted into it a tubular silencing element 7, the diameter of which is slightly less than that of the discharge stub. If it is desired that its inside diameter should correspond approximately to the nominal diameter of the connecting line, the discharge stub can be embodied with a correspondingly larger diameter. Normally, this will not be considered necessary.

An annular groove 8 is provided as standard in the discharge stub 6 to hold the tube 7, and an elastic ring 9 can be inserted into this groove to hold the tube 7 relative to the tubular stub 6 in a manner which is not sensitive to tolerances and is free from rattling. To ensure that the tube 6 cannot be inserted too far during assembly, a step 10 serving as a supporting stop is arranged in the discharge space on the housing, and the lower end of the tube 7 comes to rest on this step at one point on the circumference of the said tube without thereby significantly reducing the free cross-section of flow of the tube.

The invention makes it possible to retrofit a standard pump with the silencing element where there are high requirements made on the silencing, and it is not necessary to carry out any modifications to the assembled pump as such.

In the simplest case, the tubular silencing element has a circular cross-section. However, it can have a different cross-section from this. This applies, in particular, to its bottom end, the end which enters the discharge space. In addition, it does not have to be tubular over its entire length. Moreover, the tubular shape does not have to be closed over the entire circumference. However, this is expedient in the section in which the silencing element lies within the discharge stub to enable it to be held uniformly on all sides.

In the example illustrated, the silencing element ends at the bottom in an end face extending at right angles to its longitudinal direction. Since, as regards the silencing function, the important points are the formation of the wall in relation to the remainder of the discharge space and, in particular, the position of the bottom edges of the wall of the silencing element, the bottom end edge of the silencing element can, however, also have some other configuration. Provision may be made, for example, for it to extend further down on its side facing the discharge openings 5 than on its opposite side.

Provision can furthermore be made for openings distributed uniformly or irregularly over its lateral surface to be provided in its length which projects into the discharge space, allowing the medium to enter through these in addition to its end opening.

In a special embodiment which corresponds to the exemplary embodiment in accordance with FIG. IV of European Patent 644332, the silencing element is of double-walled design, the two walls being connected leaktightly to one another at the top in order to form between them a buffer space which is open downwards towards the discharge space.

We claim:

1. Liquid-ring gas pump comprising a discharge space (4), a discharge stub (6) connected to the top of the discharge space, a removable tubular silencing element (7) extending downwardly through the discharge stub into the discharge space (4) and an elastic ring holding the silencing element within the discharge stub.

2. Liquid-ring gas pump according to claim 1, characterized in that the silencing element (7) is inserted through the discharge stub from outside.

3. Liquid-ring gas pump comprising a discharge space (4), a discharge stub (6) connected to the top of the discharge space, a removable tubular silencing element (7) having one end extending downwardly through the discharge stub into the discharge space and a supporting stop (10) in the discharge space for engagement by the one end of the silencing element.

4. Liquid-ring gas pump according to claim 3 including means for guiding the silencing element (7) in the discharge stub (6).

5. Liquid-ring gas pump according to claim 3 including means for holding the silencing element (7) in the discharge stub (6).

6. Liquid-ring gas pump according to claim 3 including sealing means interposed between the silencing element (7) and the discharge stub (6).

* * * * *